US008643287B2

(12) United States Patent
Jou

(10) Patent No.: US 8,643,287 B2
(45) Date of Patent: Feb. 4, 2014

(54) LIGHTING DEVICE WITH SWITCHABLE DAY/NIGHT ILLUMINATION MODE

(75) Inventor: Jwo-Huei Jou, Taipei (TW)

(73) Assignee: National Tsing Hua University, Hsinchu (TW)

( * ) Notice: Subject to any disclaimer, the term of this patent is extended or adjusted under 35 U.S.C. 154(b) by 402 days.

(21) Appl. No.: 13/184,716

(22) Filed: Jul. 18, 2011

(65) Prior Publication Data

US 2012/0319593 A1 Dec. 20, 2012

(30) Foreign Application Priority Data

Jun. 15, 2011 (TW) ..... 100120922 A

(51) Int. Cl.
*H05B 37/02* (2006.01)

(52) U.S. Cl.
USPC ..... 315/156; 362/230; 362/231; 362/642

(58) Field of Classification Search
USPC ..... 362/157, 230, 231, 641, 642; 315/149, 315/156, 159
See application file for complete search history.

(56) References Cited

U.S. PATENT DOCUMENTS

| | | | | |
|---|---|---|---|---|
| 8,025,421 | B2 * | 9/2011 | Ku | 362/231 |
| 2003/0071934 | A1 * | 4/2003 | Saccomanno et al. | 349/61 |
| 2010/0039792 | A1 * | 2/2010 | Meyers et al. | 362/20 |

* cited by examiner

*Primary Examiner* — Thuy Vinh Tran

(57) ABSTRACT

The present invention relates to a lighting device with switchable day/night illumination mode, comprising: a main controlling unit, a driving unit, a lighting unit, a light filtering unit, an illumination mode switching unit, and a power management unit, wherein the lighting unit is coupled to the driving unit and has a plurality of light-emitting devices. Moreover, the main controlling unit is used for controlling the driving unit, so as to drive the lighting unit output a visible light. In addition, the illumination mode switching unit is used for controlling the light filtering unit to show and cover the light-emitting surface of the lighting unit, so as to filter the visible light and make the visible light become a visible light with a specific wavelength; wherein the visible light with specific wavelength causes the smallest excitation to human sympathetic. Thus, using the visible light with specific wavelength as illumination light at night can not only assist users in reading, but also avoid from exciting users' sympathetic and causing melatonin suppression.

20 Claims, 10 Drawing Sheets

LIGHTING DEVICE WITH SWITCHABLE DAY/NIGHT ILLUMINATION MODE

CROSS-REFERENCE TO RELATED APPLICATION

This application claims foreign priority from a Taiwan Patent Application, Ser. No. 100120922, filed on Jun. 15, 2011.

BACKGROUND OF THE INVENTION

1. Technical Field

The present invention relates to a lighting device, and more particularly, to a lighting device with switchable day/night illumination mode, capable of outputting a visible light at day and outputting a visible light with a specific wavelength at night, respectively.

2. Description of Related Art

Melatonin is secreted by a gland of Pineal body in human brain, and it has the following influences on physiological functions of human: (1) promoting sleep; (2) affecting emotion; (3) sexual maturity and reproduction; and (4) affecting the immune functions.

Moreover, Researches have been found that the production and the secretion of melatonin are mainly influenced by the following three factors: (A) light: light is transmitted to hypothalamus through retinal nerves, and then transmitted to pineal body through the sympathetic nerves, so as to inhibit the secretion of melatonin, therefore the secretion of melatonin can be inhibited in higher level under the darker environment; (B) circadian rhythm: hypothalamus, like a biological clock, can affect the secretion of melatonin, so that the concentration of melatonin secreted by pineal body has a significant variation according to circadian rhythm, and the concentration of melatonin in blood in the night is 6 times higher than that in the day according to researches; and (C) electromagnetic wave: an electromagnetic wave can not only inhibit the ability of pineal body for synthesizing melatonin, but also inhibit the activity of the synthesis of melatonin.

Light is indispensable in daily life. The light perceivable by human eyes is called visible light, wherein the major natural light is sunlight, and the artificial light has various kinds, such as candlelight, incandescent lamps, fluorescent lamps, LED lamp, OLED lamps, etc. Generally speaking, the wavelength range of the visible light is about 450 nm to 750 nm; the color components of the visible light include red, orange, yellow, green, blue, purple, etc.

Besides, researchers also found that melatonin has the highest sensitivity and the second highest sensitivity under the purple light and the blue light, respectively; therefore, generally, the purple light is not directly used as the artificial light for human beings, but the blue light and the red light are often mixed and then be used as the artificial white light. Thus the lighting devices for emitting the white light, such as an incandescent lamp, an LED lamp and an OLED lamp, all of them contain the blue light component. However, it knows that melatonin has high sensitivity to blue the light, thus, if human body is exposed under the blue light for a long period, the phenomenon of melatonin suppression might be induced, and furthermore, insomnia and mood disorders could also be induced. Based on the above reasons, it is able to know that, when during night, it should better for not using any light sources, such that the light can be avoid from being transmitted to hypothalamus through retinal nerves and transmitted to pineal body through the sympathetic nerves, so that, it would not inhibit the secretion of melatonin.

However, for some people having reading habit before bedtime, the artificial light can not be avoided from using to assist people in reading. Although there are sold a variety of night lamps and reading lamps in the market, the light outputted from the night lamps or the reading lamps still includes the short-wavelength light component which will excites people sympathetic. However, researches have been found that, under the condition of one lumen, the orange light having 617 nm wavelength causes the smallest excitation to people sympathetic at night. Accordingly, for the people having reading habit before bedtime, they can adapted the orange light having 617 nm wavelength as the illumination light for reading, so that, they can not only obtain the illumination light for assisting in reading, but also avoid from exciting their sympathetic and causing melatonin suppression.

So that, in view of the sold night lamps and reading lamps are not suitable for using to assist people in reading, the inventor of the present application has made great efforts to make inventive research thereon and eventually provided lighting device with switchable day/night illumination mode.

BRIEF SUMMARY OF THE INVENTION

The primary objective of the present invention is to provide a lighting device with switchable day/night illumination mode, in which, a light filtering unit is used to cover the light-emitting surface of a lighting unit, so that, when the lighting unit outputs a visible light, the light filtering unit would filter the visible light and make the visible light become a visible light with a specific wavelength, wherein the visible light with specific wavelength causes the smallest excitation to human sympathetic; Therefore, using the visible light with specific wavelength as illumination light when night can not only assist users in reading, but also avoid from exciting users' sympathetic and causing melatonin suppression.

Accordingly, to achieve the abovementioned primary objective of the present invention, the inventor proposes a lighting device with switchable day/night illumination mode, comprising:

a main controlling unit;

a driving unit, coupled to the main controlling unit;

a lighting unit, coupled to the driving unit and has a plurality of light-emitting devices, wherein the main controlling unit can control the driving unit to drive the lighting unit, so as to output a visible light;

a light filtering unit, disposed over a light-emitting surface of the lighting unit, used for filtering the visible light and making the visible light become a visible light with a specific wavelength;

an illumination mode switching unit, coupled to the main controlling unit, wherein the illumination mode switching unit is used for controlling and switching the light filtering unit, so that the light filtering unit shows and covers the light-emitting surface of the lighting unit, and then the visible light outputted from the lighting unit is filtered by the light filtering unit and becomes the visible light with the specific wavelength; Moreover, the illumination mode switching unit is able to control and switch the light filtering unit, such that the light filtering unit is withdrawn and stops covering the light-emitting surface of the lighting unit, and then the lighting unit outputs the visible light; and a power management unit, coupled to the main controlling unit for providing the power to the main controlling unit.

The second objective of the present invention is to provide a lighting device with switchable day/night illumination mode, in which, a light converting unit is used to cover the light-emitting surface of a lighting unit, so that, when the lighting unit outputs a visible light, the light filtering unit would convert the visible light to a visible light with a specific wavelength, wherein the visible light with specific wavelength causes the smallest excitation to human sympathetic; Therefore, using the visible light with specific wavelength as illumination light when night can not only assist users in reading, but also avoid from exciting users' sympathetic and causing melatonin suppression.

Thus, to achieve the abovementioned second objective of the present invention, the inventor proposes a lighting device with switchable day/night illumination mode, comprising:

a main controlling unit;

a driving unit, coupled to the main controlling unit;

a lighting unit, coupled to the driving unit and having a plurality of light-emitting devices, wherein the main controlling unit can control the driving unit to drive the lighting unit, so as to output a visible light;

a light converting unit, disposed over a light-emitting surface of the lighting unit, used for converting the visible light to a visible light with a specific wavelength;

an illumination mode switching unit, coupled to the main controlling unit, wherein the illumination mode switching unit is used for controlling and switching the light converting unit, so that the light converting unit shows and covers the light-emitting surface of the lighting unit, and then the visible light outputted from the lighting unit is converted by the light converting unit and becomes the visible light with the specific wavelength; Moreover, the illumination mode switching unit is able to control and switch the light converting unit, such that the light converting unit is withdrawn and stops covering the light-emitting surface of the lighting unit, and then the lighting unit outputs the visible light; and a power management unit, coupled to the main controlling unit for providing the power to the main controlling unit.

The third objective of the present invention is to provide a lighting device with switchable day/night illumination mode, in which, a switching unit is used for switching when the lighting unit emits a visible light, such that the number of the light-emitting devices used for emitting light is able to be adjusted and the light-emitting devices in the plurality of light-emitting devices 131*b* capable of emitting a visible light with a specific wavelength can be controlled to emit light. Therefore, using the visible light with specific wavelength as illumination light at night can not only assist users in reading, but also avoid from exciting users' sympathetic and causing melatonin suppression.

Thus, to achieve the abovementioned third objective of the present invention, the inventor proposes a lighting device with switchable day/night illumination mode, comprising:

a main controlling unit;

a driving unit, coupled to the main controlling unit;

a lighting unit, coupled to the driving unit and has a plurality of light-emitting devices, wherein the main controlling unit can control the driving unit to drive the lighting unit, so as to output a visible light;

a first switching unit, coupled to the main controlling unit, wherein when the driving unit drives the lighting unit to output the visible light, the first switching unit may be used for controlling and adjusting the number of the light-emitting devices used for emitting light, or controlling the some light-emitting devices in the plurality of light-emitting devices capable of emitting a visible light with a specific wavelength to emit light and controlling the some light-emitting devices in the plurality of light-emitting devices can not emit the visible light with a specific wavelength not to emit light; and a power management unit, being coupled to the main controlling unit for providing the power to the main controlling unit.

BRIEF DESCRIPTION OF THE SEVERAL VIEWS OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE INVENTION

To more clearly describe a lighting device with switchable day/night illumination mode according to the present invention, embodiments of the present invention will be described in detail with reference to the attached drawings hereinafter.

Figure 1A:
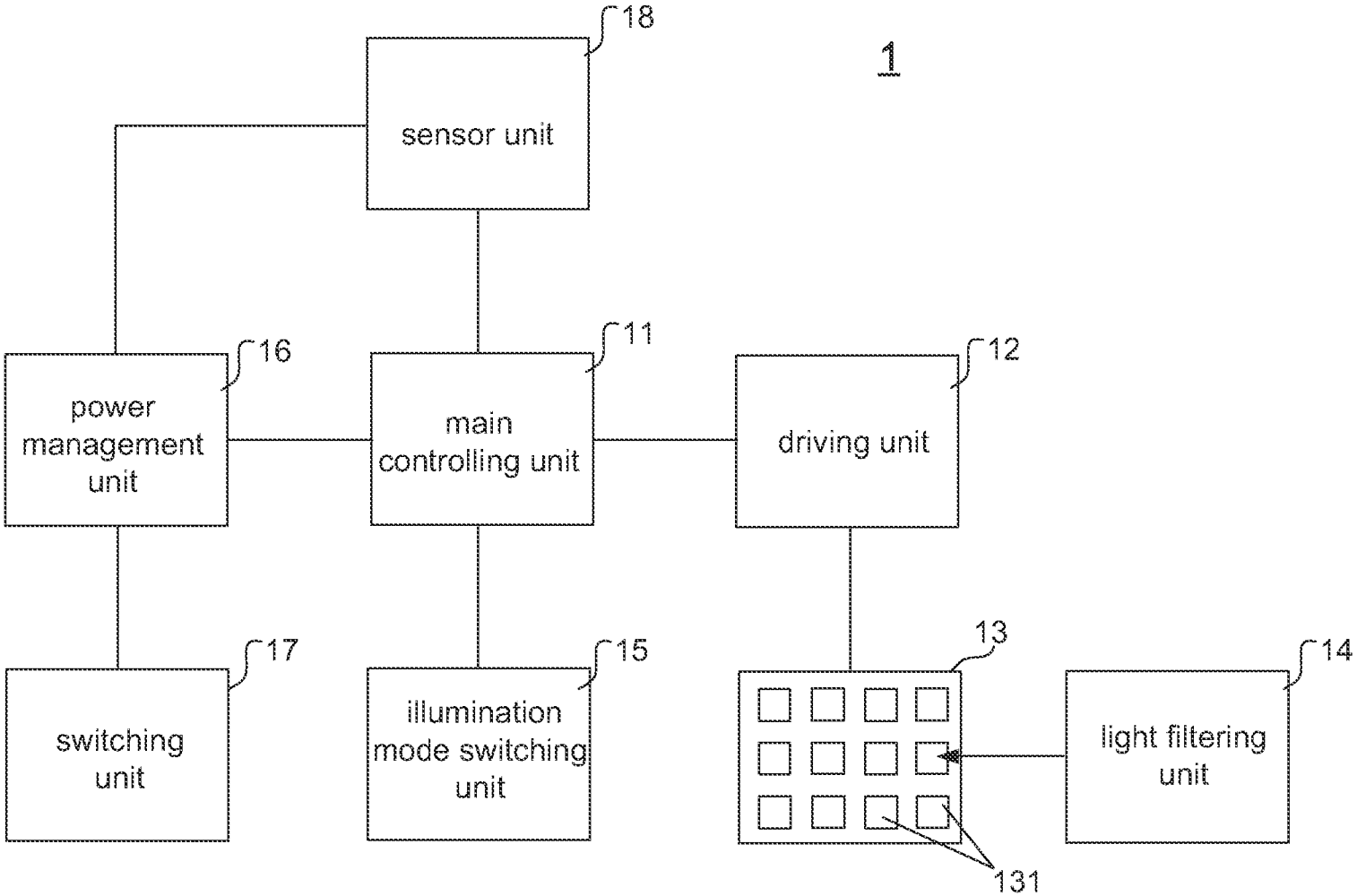
FIG. 1A is a first framework view of a first embodiment of a lighting device with switchable day/night illumination mode according to the present invention.

Please refer to FIG. 1A, which illustrates a first framework view of a first embodiment of a lighting device with switchable day/night illumination mode according to the present invention. As shown in FIG. 1A, the lighting device with switchable day/night illumination mode 1 includes: a main controlling unit 11, a driving unit 12, a lighting unit 13, a light filtering unit 14, an illumination mode switching unit 15, a power management unit 16, a switching unit 17, and a sensor unit 18, wherein the driving unit 12 is coupled to the main controlling unit 11, and the lighting unit 13 is coupled to the driving unit 12 and has a plurality of light-emitting devices 131. In the first embodiment of the lighting device with switchable day/night illumination mode 1, it can use bulbs, fluorescent lamps, LED chips, or OLED chips as the light-emitting devices 131, in addition, the main controlling unit 11 is able to control the driving unit 12, such that the driving unit 12 drives the light-emitting devices 131 of the lighting unit 13 to emit light, and then the lighting unit 13 output a visible light.

Continuously referring to FIG. 1A, the light filtering unit 14 is disposed over a light-emitting surface of the lighting unit 13, used for filtering the visible light and making the visible light become a visible light with a specific wavelength. The illumination mode switching unit 15 is also coupled to the main controlling unit 11, used for controlling and switching the light filtering unit 14, so that the light filtering unit 14 shows and covers the light-emitting surface of the lighting unit 13, and the visible light outputted from the lighting unit 13 is filtered by the light filtering unit 14, so as to become the visible light with the specific wavelength. Moreover, the illumination mode switching unit 15 is able to control and switch the light filtering unit 14, such that the light filtering unit 14 is withdrawn and stops covering the light-emitting surface of the lighting unit 13, and then the lighting unit 13 outputs the normal visible light. Herein, it must to explain that, since the orange light having 617 nm wavelength causes the smallest excitation to human sympathetic; thus, preferably, in the first embodiment of the lighting device with switchable day/night illumination mode 1, the visible light with the specific wavelength is that an orange light having 617 nm wavelength.

The power management unit 16 is coupled to the main controlling unit 11 for providing the power to the main controlling unit 11, and the switching unit 17 is coupled to the power management unit 16 for switching the power management unit 16 ON/OFF, wherein when the power management unit 16 is turn OFF, the lighting unit 13 stops outputting the visible light. In addition, the sensor unit 18 is coupled to the main controlling unit 11 and the power management unit 16, used for detecting the light intensity of an external environment. When night is coming, the sensor unit 18 would output a first switch signal to the main controlling unit 11, and the main controlling unit 11 would control the illumination mode switching unit 15 to switch the light filtering unit 14 to show and cover the light-emitting surface of the lighting unit 13. Moreover, when day is coming, the sensor unit 18 would output a second switch signal to the main controlling unit 11, and the main controlling unit 11 would control the illumination mode switching unit 15 to switch the light filtering unit 14 to withdraw for stopping covering the light-emitting surface of the lighting unit 13.

Figure 1B:
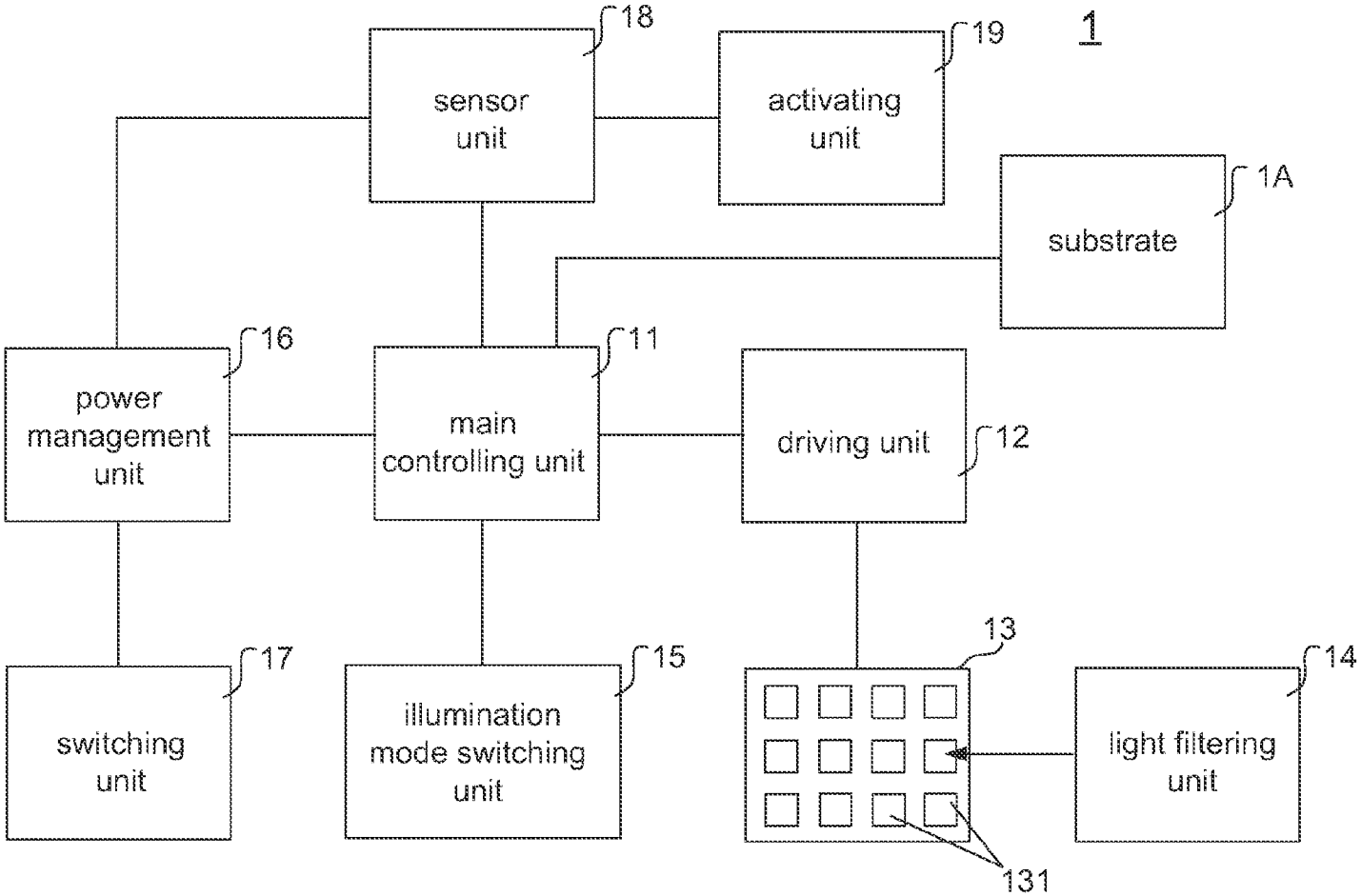
FIG. 1B is a second framework view of the first embodiment of the lighting device with switchable day/night illumination mode according to the present invention.

Furthermore, please refer to FIG. 1B, which illustrates a second framework view of the first embodiment of the lighting device with switchable day/night illumination mode according to the present invention. For the first embodiment of the lighting device with switchable day/night illumination mode, as shown in FIG. 1B, it further includes an activating unit 19, which is coupled to the sensor unit 18 for activating the sensor unit 18 to detect the light intensity of the environment.

Figure 2A:
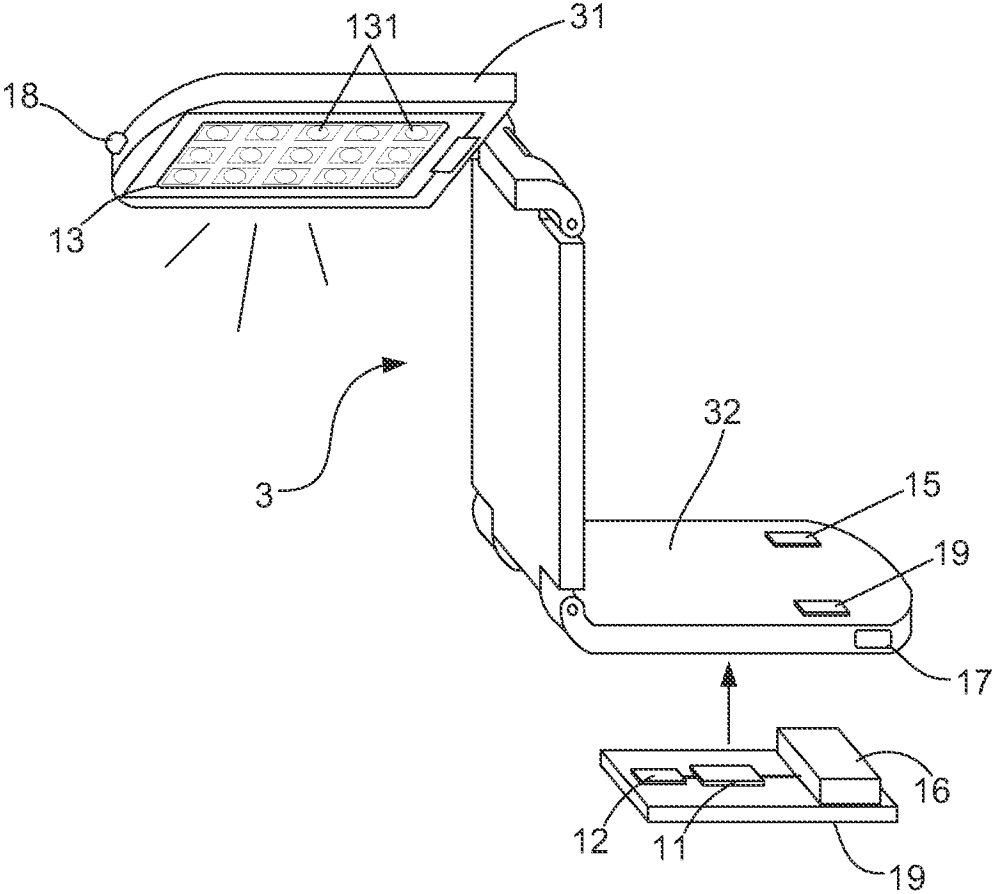
FIG. 2A and FIG. 2B are an exemplary embodiment for a desk lamp of lighting device with switchable day/night illumination mode according to the present invention.

Thus, through above descriptions, the basic framework of the lighting device with switchable day/night illumination mode of the present invention has been completely introduced and disclosed. Besides, for more clearly describing the lighting device with switchable day/night illumination mode of the present invention, it will further introduce the lighting device through exemplary embodiments. Please continuously refer to FIG. 1A and FIG. 1B, and simultaneously referring to FIG. 2A and FIG. 2B, there are shown an exemplary embodiment for a desk lamp of lighting device with switchable day/night illumination mode according to the present invention. As shown in FIG. 2A, the plurality of light-emitting devices 131 of the lighting unit 13 are disposed in a lampshade 31 of a desk lamp, and the sensor unit 18 is equipped on the front end of the lampshade 31 for detecting the light intensity of the environment. In addition, the main controlling unit 11, the driving unit 12 and the power management unit 16 are implemented on a substrate 1A, wherein the substrate 1A is disposed inside a base 32 of the desk lamp 3. The illumination mode switching unit 15, the activating unit 19 and the switching unit 17 are disposed on the top surface and the side surface of the base 32, respectively.

Figure 2B:
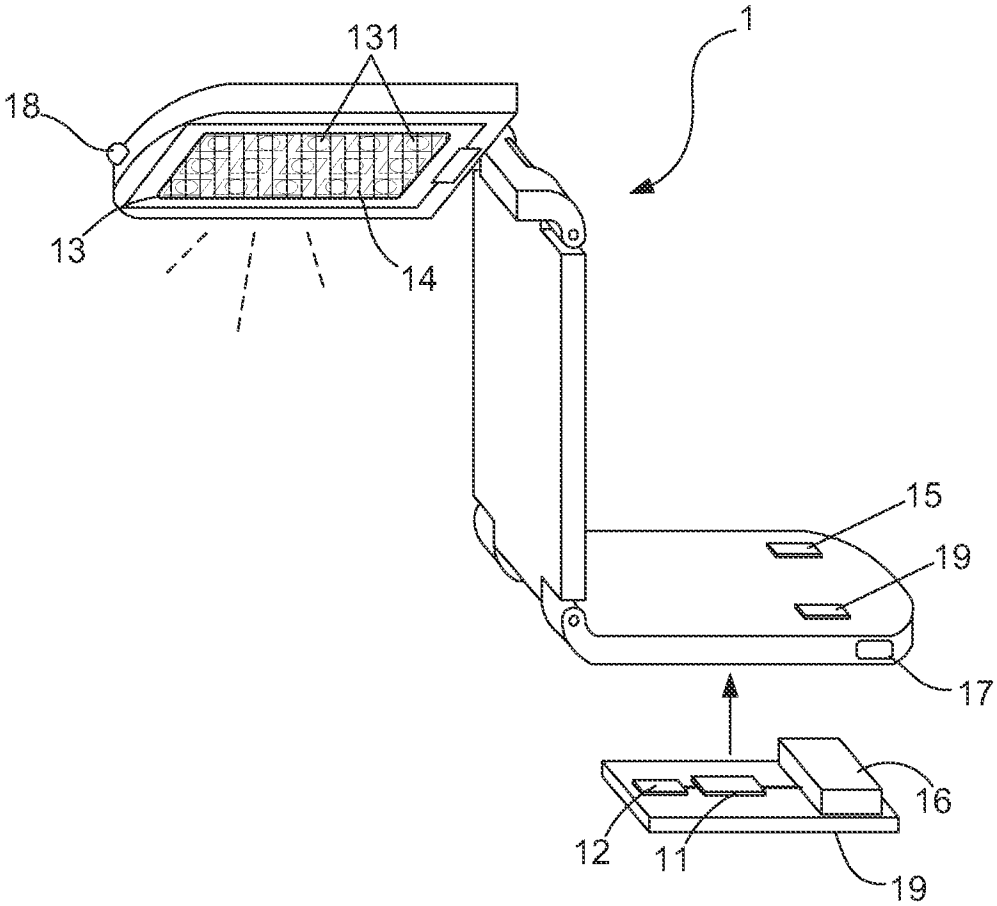

As shown in FIG. 2B, After a user presses the illumination mode switching unit 15, the light filtering unit 14 shows and covers the light-emitting surface of the lighting unit 13, and then the lighting unit 13 outputs the visible light with the specific wavelength, i.e., the orange light having 617 nm wavelength. Meanwhile, when the user presses the illumination mode switching unit 15 again, the light filtering unit 14 is withdrawn and stops covering the light-emitting surface of the lighting unit 13, such that the lighting unit 13 outputs the normal visible light.

Similarly, as shown in FIG. 2B, when the user presses the activating unit 19 for activating the sensor unit 18 to continuously detect the light intensity of the environment until the night comes, the sensor unit 18 would output the first switch signal to the main controlling unit 11, and the main controlling unit 11 would control the illumination mode switching unit 15 to switch the light filtering unit 14 to show and cover the light-emitting surface of the lighting unit 13. Moreover, when the day comes, the sensor unit 18 would output the second switch signal to the main controlling unit 11, and the main controlling unit 11 would control the illumination mode switching unit 15 to switch the light filtering unit 14 to withdraw for stopping covering the light-emitting surface of the lighting unit 13.

Figures 3A, 3B:
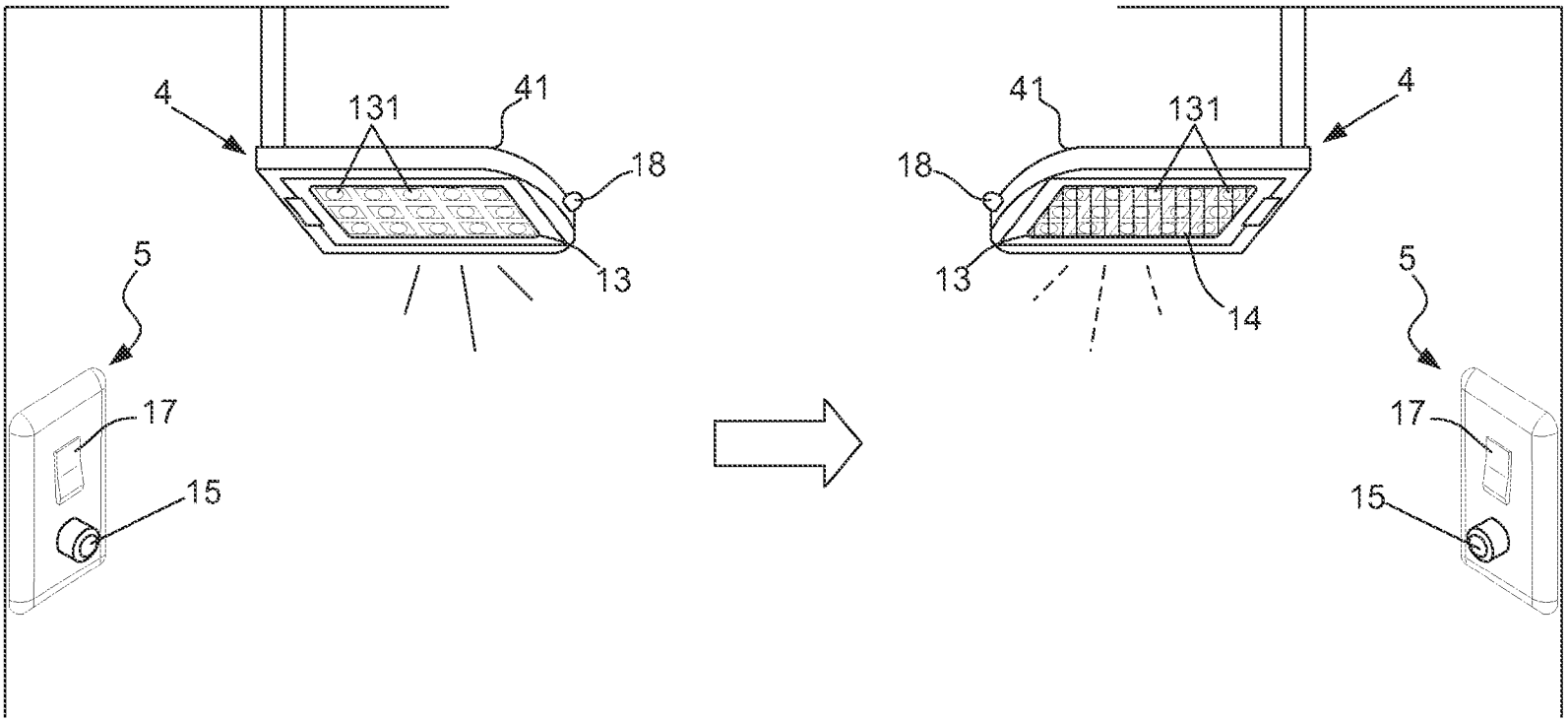
FIG. 3A and FIG. 3B are an exemplary embodiment for a chandelier of the lighting device with switchable day/night illumination mode according to the present invention.

Please continuously refer to FIG. 3A and FIG. 3B, there are shown an exemplary embodiment for a chandelier of the lighting device with switchable day/night illumination mode according to the present invention. As shown in FIG. 3A, the lighting device with switchable day/night illumination mode of the present invention is practice to a chandelier 4, in which, the plurality of light-emitting devices 131 of the lighting unit 13 are disposed inside a housing 41 of the chandelier 4, and the sensor unit 18 is equipped on the front end of the housing 41, used for used for detecting the light intensity of the environment. In addition, the main controlling unit 11, the driving unit 12 and the power management unit 16 are disposed in an operation interface 5; the illumination mode switching unit 15 and the switching unit 17 are disposed on the surface of the operation interface 5, respectively.

The same to the exemplary embodiment of the desk lamp, in the exemplary embodiment of the chandelier 4, as shown in FIG. 3B, after a user presses the illumination mode switching unit 15, the light filtering unit 14 shows and covers the light-emitting surface of the lighting unit 13, and then the lighting unit 13 outputs the visible light with the specific wavelength, i.e., the orange light having 617 nm wavelength. Meanwhile, when the user presses the illumination mode switching unit 15 again, the light filtering unit 14 is withdrawn and stops covering the light-emitting surface of the lighting unit 13, such that the lighting unit 13 outputs the normal visible light. Besides, when the user presses the activating unit 19 for activating the sensor unit 18 to continuously detect the light intensity of the environment until the night comes, the sensor unit 18 would output the first switch signal to the main controlling unit 11, and the main controlling unit 11 would control the illumination mode switching unit 15 to switch the light filtering unit 14 to show and cover the light-emitting surface of the lighting unit 13. Moreover, when the day comes, the sensor unit 18 would output the second switch signal to the main controlling unit 11, and the main controlling unit 11 would control the illumination mode switching unit 15 to switch the light filtering unit 14 to withdraw for stopping covering the light-emitting surface of the lighting unit 13.

Please refer to FIG. 1B again, in the first embodiment of the lighting device with switchable day/night illumination mode, it can further includes a brightness switching unit 1A, which is coupled to the main controlling unit 11, wherein when the driving unit 12 drives the lighting unit 13 to output the visible light, the brightness switching unit 1A may be used for adjusting the intensity of the visible light outputted by the lighting unit 13. Thus, for some people having reading habit before bedtime, they can use the visible light with low intensity for assist in reading, so that, they can avoid from exciting their sympathetic and causing melatonin suppression.

Figure 4A:
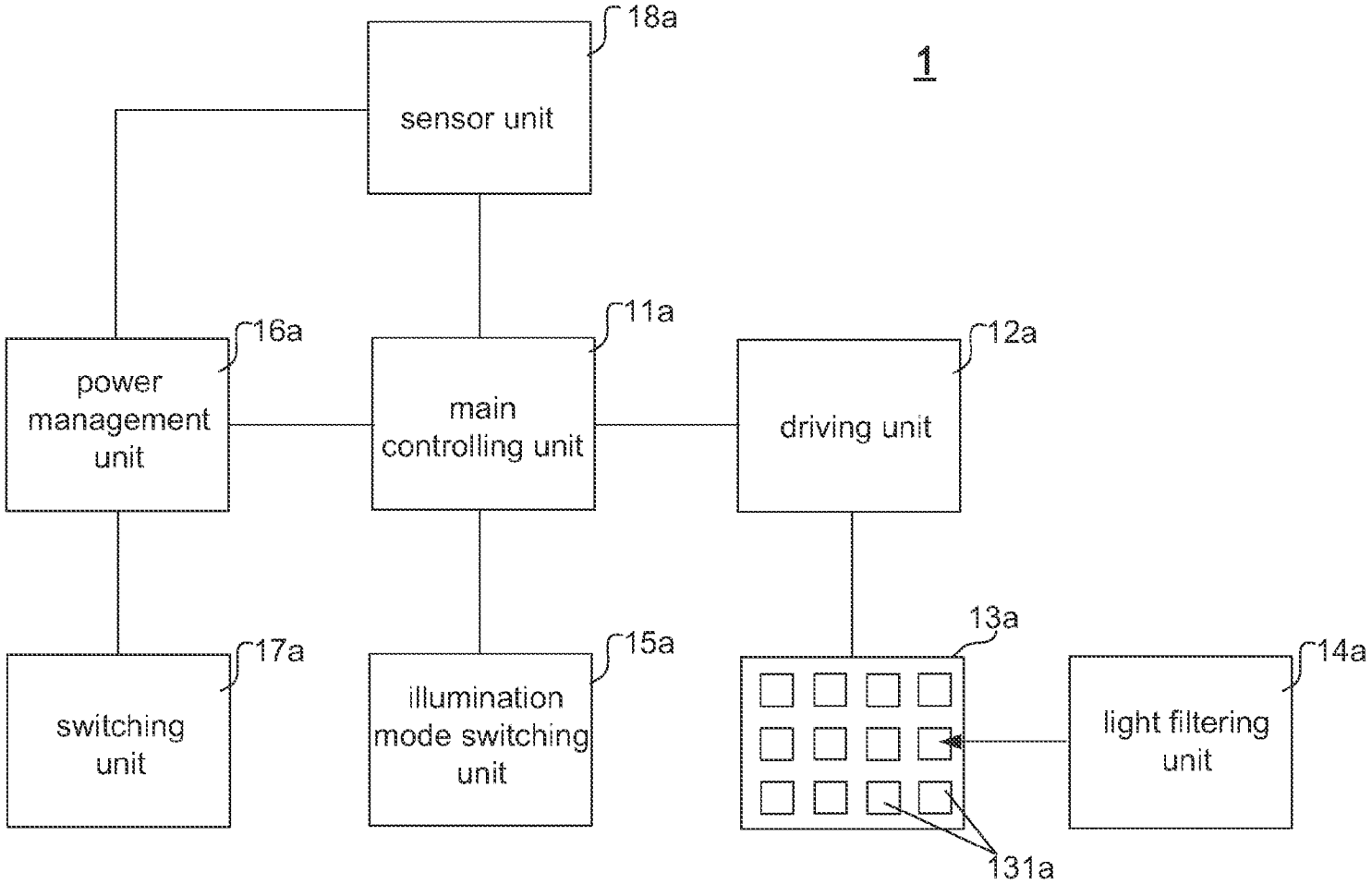
FIG. 4A is a first framework view of a second embodiment of the lighting device with switchable day/night illumination mode according to the present invention.

The present invention further includes a second embodiment for introducing the lighting device with switchable day/night illumination mode. Please refer to FIG. 4A, which illustrates a first framework view of a second embodiment of the lighting device with switchable day/night illumination mode according to the present invention. In the second embodiment, as shown in FIG. 4A, the lighting device with switchable day/night illumination mode 1 includes: a main controlling unit 11*a*, a driving unit 12*a*, a lighting unit 13*a*, a light converting unit 14*a*, an illumination mode switching unit 15*a*, a power management unit 16*a*, a switching unit 17*a*, and a sensor unit 18*a*, wherein the driving unit 12*a* is coupled to the main controlling unit 11*a*, and the lighting unit 13*a* is coupled to the driving unit 12*a* and has a plurality of light-emitting devices 131*a*. In the second embodiment of the lighting device with switchable day/night illumination mode 1, the main controlling unit 11*a* is able to control the driving unit 12*a*, such that the driving unit 12*a* drives the light-emitting devices 131*a* of the lighting unit 13*a* to emit light, and then the lighting unit 13*a* outputs a visible light.

Referring to FIG. 4A again, the light converting unit 14*a* is disposed over a light-emitting surface of the lighting unit 13*a*, used for converting the visible light to a visible light with a specific wavelength. The illumination mode switching unit 15*a* is also coupled to the main controlling unit 11*a*, wherein the illumination mode switching unit 15*a* is used for controlling and switching the light converting unit 14*a*, so that the light converting unit 14*a* shows and covers the light-emitting surface of the lighting unit 13*a*, and then the visible light outputted from the lighting unit 13*a* is converted by the light converting unit 14*a* and becomes the visible light with the specific wavelength; Moreover, the illumination mode switching unit 15*a* can control and switch the light converting unit 14*a*, such that the light converting unit 14*a* is withdrawn and stops covering the light-emitting surface of the lighting unit 13*a*, and then the lighting unit 13*a* outputs the visible light.

The switching unit 17*a* is coupled to the power management unit 16*a* for switching the power management unit 16*a* ON/OFF, wherein when the power management unit 16*a* is turn OFF, the lighting unit 13*a* stops outputting the visible light. In addition, the sensor unit 18*a* is coupled to the main controlling unit 11*a* and the power management unit 16*a*, used for detecting the light intensity of an external environment. When night is coming, the sensor unit 18*a* would output a first switch signal to the main controlling unit 11*a*, and the main controlling unit 11*a* would control the illumination mode switching unit 15*a* to switch the light filtering unit 14*a* to show and cover the light-emitting surface of the lighting unit 13*a*; Moreover, when day is coming, the sensor unit 18*a* would output a second switch signal to the main controlling unit 11*a*, and the main controlling unit 11*a* would control the illumination mode switching unit 15*a* to switch the light filtering unit 14*a* to withdraw for stopping covering the light-emitting surface of the lighting unit 13*a*.

Figure 4B:
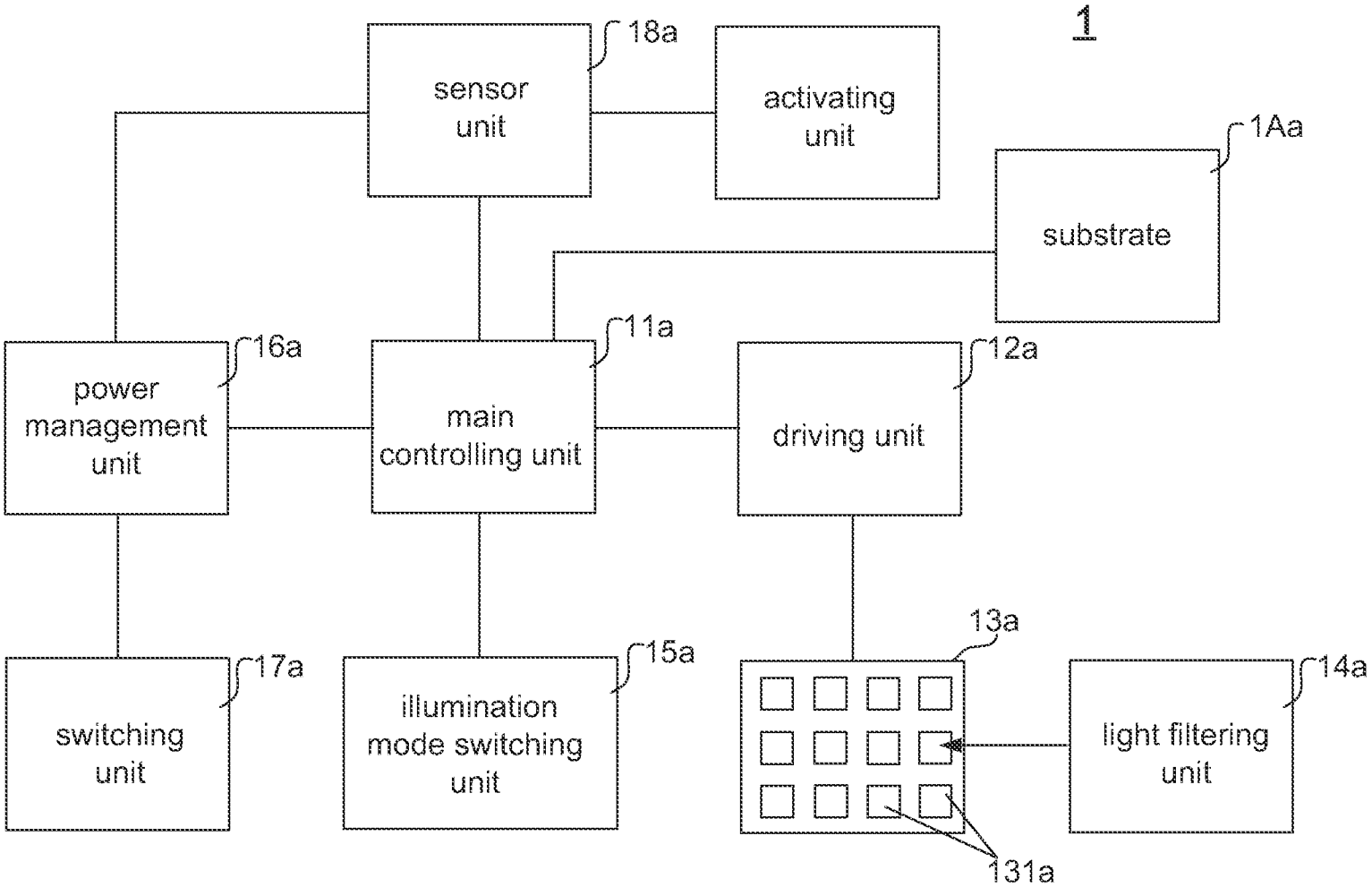
FIG. 4B is a second framework view of the second embodiment of the lighting device with switchable day/night illumination mode according to the present invention.

Moreover, the same to the aforesaid first embodiment, the second embodiment of the lighting device with switchable day/night illumination mode can further include an activating unit. Please refer to FIG. 4B, which illustrates a second framework view of the second embodiment of the lighting device with switchable day/night illumination mode according to the present invention. For the second embodiment of the lighting device with switchable day/night illumination mode 1, as shown in FIG. 4B, it further includes an activating unit 19*a*, coupled to the sensor unit 18*a* for activating the sensor unit 18*a* to detect the light intensity of the environment.

Thus, through above descriptions, the second embodiment of the lighting device with switchable day/night illumination mode has been clearly introduced and disclosed. Besides, the same to aforesaid first embodiment, the second embodiment of the lighting device with switchable day/night illumination mode can also be practice to an exemplary desk lamp (shown in FIG. 2A and FIG. 2B) and an exemplary chandelier (shown in FIG. 3A and FIG. 3B). Moreover, please refer to FIG. 4B again, in the second embodiment of the lighting device with switchable day/night illumination mode, it can further includes a brightness switching unit 1Aa, which is coupled to the main controlling unit 11*a*, wherein when the driving unit 12*a* drives the lighting unit 13*a* to output the visible light, the brightness switching unit 1Aa may be used for adjusting the intensity of the visible light outputted by the lighting unit 13*a*. Thus, for some people having reading habit before bedtime, they can use the visible light with low intensity for assist in reading, so that, they can avoid from exciting their sympathetic and causing melatonin suppression.

Besides, the present invention further includes a third embodiment for introducing the lighting device with switchable day/night illumination mode. Please refer to FIG. 5, which illustrates a framework view of a third embodiment of the lighting device with switchable day/night illumination mode according to the present invention. In the second embodiment, as shown in FIG. 5, the third embodiment of the lighting device with switchable day/night illumination mode includes: a main controlling unit 11*b*, a driving unit 12*b*, a lighting unit 13*b*, a first switching unit 15*b*, a power management unit 16*b*, a switching unit 17*b*, a sensor unit 19*b*, and an activating unit 1Ab.

Figure 5:
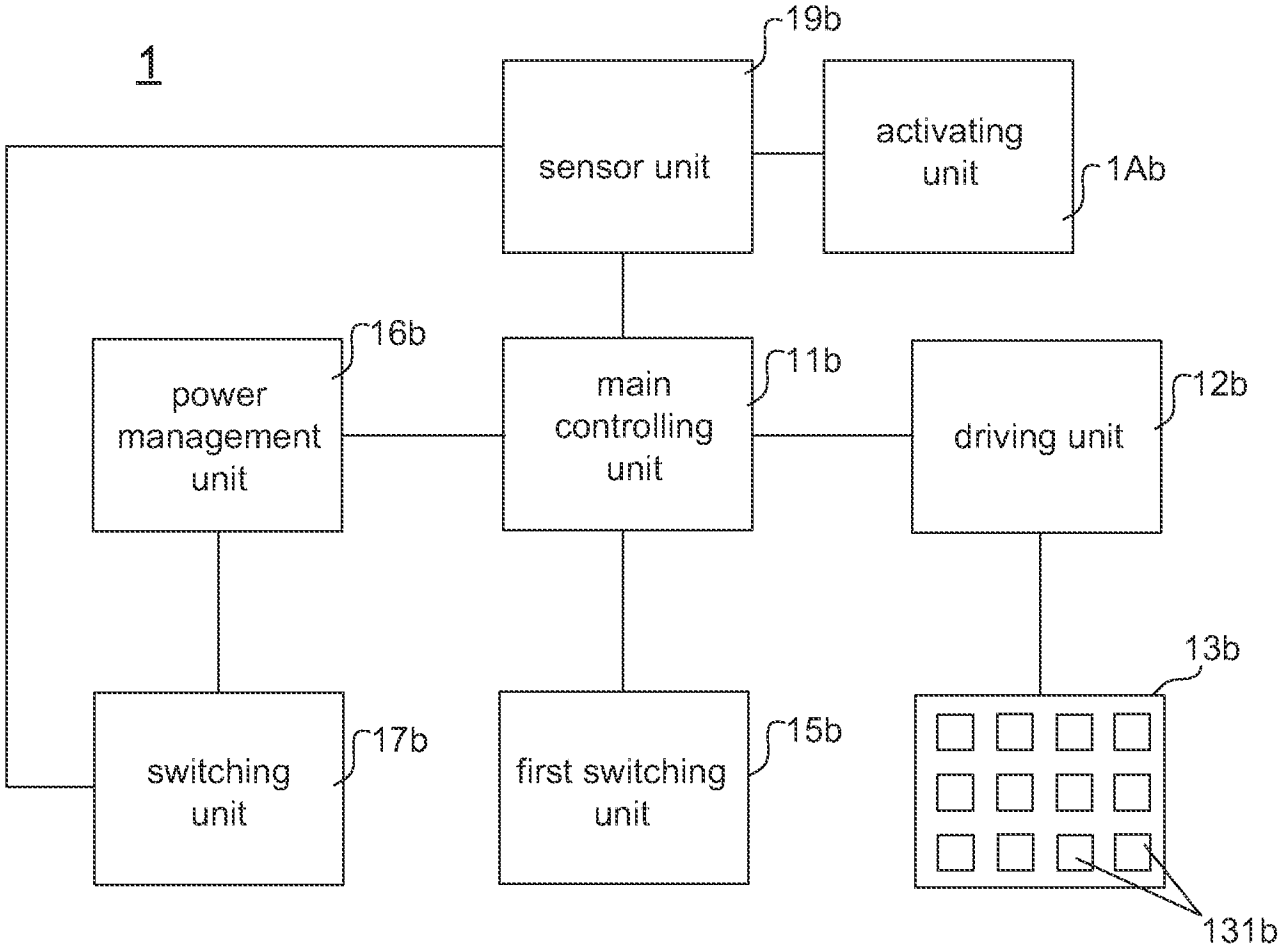
FIG. 5 is a framework view of a third embodiment of the lighting device with switchable day/night illumination mode according to the present invention.
Figure 6:
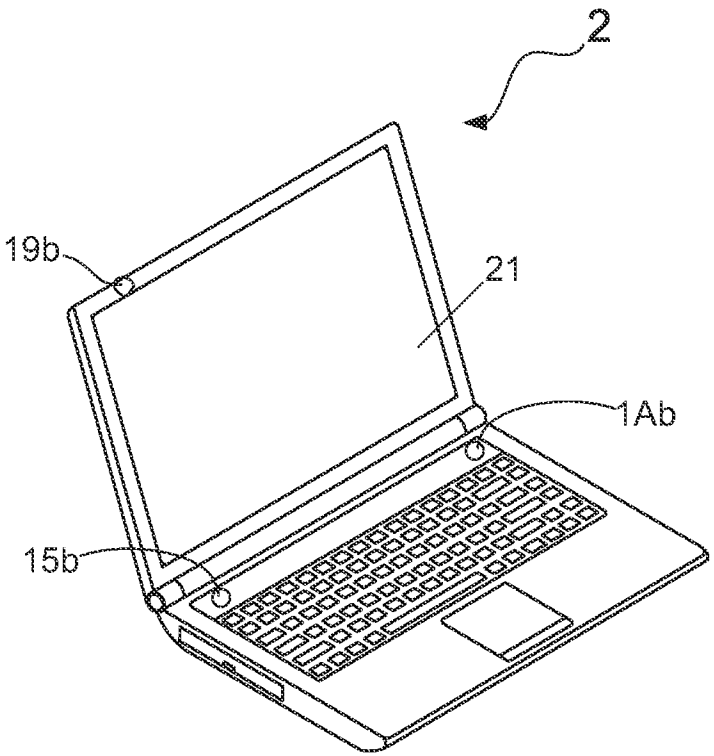
FIG. 6 is an exemplary embodiment for a display device of the lighting device with switchable day/night illumination mode according to the present invention.

Continuously referring to FIG. 5, and simultaneously referring to FIG. 6, which illustrates an exemplary embodiment for a display device of the lighting device with switchable day/night illumination mode according to the present invention. A notebook 2 is shown in FIG. 6 and the lighting device 1 with switchable day/night illumination mode of the present invention is applied as a display device 21 of the notebook 2. More clearly to say, the lighting device 1 with switchable day/night illumination mode of the present invention is applied as an LED display device or an OLED display device.

In the display device 21, the driving unit 12*b* is coupled to the main controlling unit 11*b* (the driving unit 12*b* and the main controlling unit 11*b* are not shown in FIG. 6). The lighting unit 13*b* is coupled to the driving unit 12*b* and has a plurality of light-emitting devices 131*b* (the lighting unit 13*b* and the plurality of light-emitting devices 131*b* are not shown in FIG. 6), wherein the light-emitting device 131*b* can be an OLED chip or an LED chip. The first switching unit 15*b* is coupled to the main controlling unit 11*b*, wherein when the driving unit 12*b* drives the lighting unit 13*b* to output the visible light, the first switching unit 15*b* can switch and adjust the number of the light-emitting devices 131*b* to emit light, or control the some light-emitting devices in the plurality of light-emitting devices 131*b* capable of emitting a visible light with a specific wavelength to emit light and control the some light-emitting devices in the plurality of light-emitting devices 131*b* cannot emit the visible light with a specific wavelength not to emit light. Thus, when night is coming, the user can make the lighting unit 13*b* output the visible light with the specific wavelength ranging from 597 nm to 637 nm, or furthermore, output the visible light with 617 nm wavelength (i.e., the orange light).

Moreover, after the activating unit 1Ab activates the sensor unit 19*b* to detect the light intensity of the environment, the sensor unit 19*b* would output a first switch signal to the main controlling unit 11*b* when night is coming, and the main controlling unit 11*b* would control the first switching unit 15*b* to switch and adjust the number of the light-emitting devices 131*b* used for emitting light, or control the some light-emitting devices in the plurality of light-emitting devices 131*b* capable of emitting the visible light with the specific wavelength to emit light and control the some light-emitting devices in the plurality of light-emitting devices 131*b* can not emit the visible light with the specific wavelength not to emit light.

General speaking, LED (OLED) display device includes a plurality of red LED (OLED) chips, a plurality of blue LED (OLED) chips and a plurality of green LED (OLED) chips, so that, for the lighting device 1 with switchable day/night illumination mode applied as the display device 21, the user can control the first switching unit 15*b* to switch and control the blue LED (OLED) chips not to emit light, thus, when the driving unit 12*b* drives the light unit 13*b* to output the visible light, the red LED (OLED) chips and the green LED (OLED) chips would emit the visible light with the specific wavelength ranging from 597 nm to 637 nm.

In addition, for making the lighting unit 13*b* able to emit the orange light having 617 nm wavelength, a plurality of orange LED (OLED) chips can be added into the lighting unit 13*b*; Therefore, when night is coming, the user can control the first switching unit 15*b* to switch and control the red LED (OLED) chips, the blue LED (OLED) chips and green blue LED (OLED) chips not to emit light, thus, when the driving unit 12*b* drives the light unit 13*b* to output the visible light, the orange LED (OLED) chips would emit orange light with 617 nm wavelength. Moreover, it must to note that, in addition to the display device 21 of the notebook 2, the lighting device 1 with switchable day/night illumination mode of the present invention can also be applied as the display device 21 of an LCD TV, an LCD display, a smart phone, a multimedia player, and an e-book.

Figure 7:
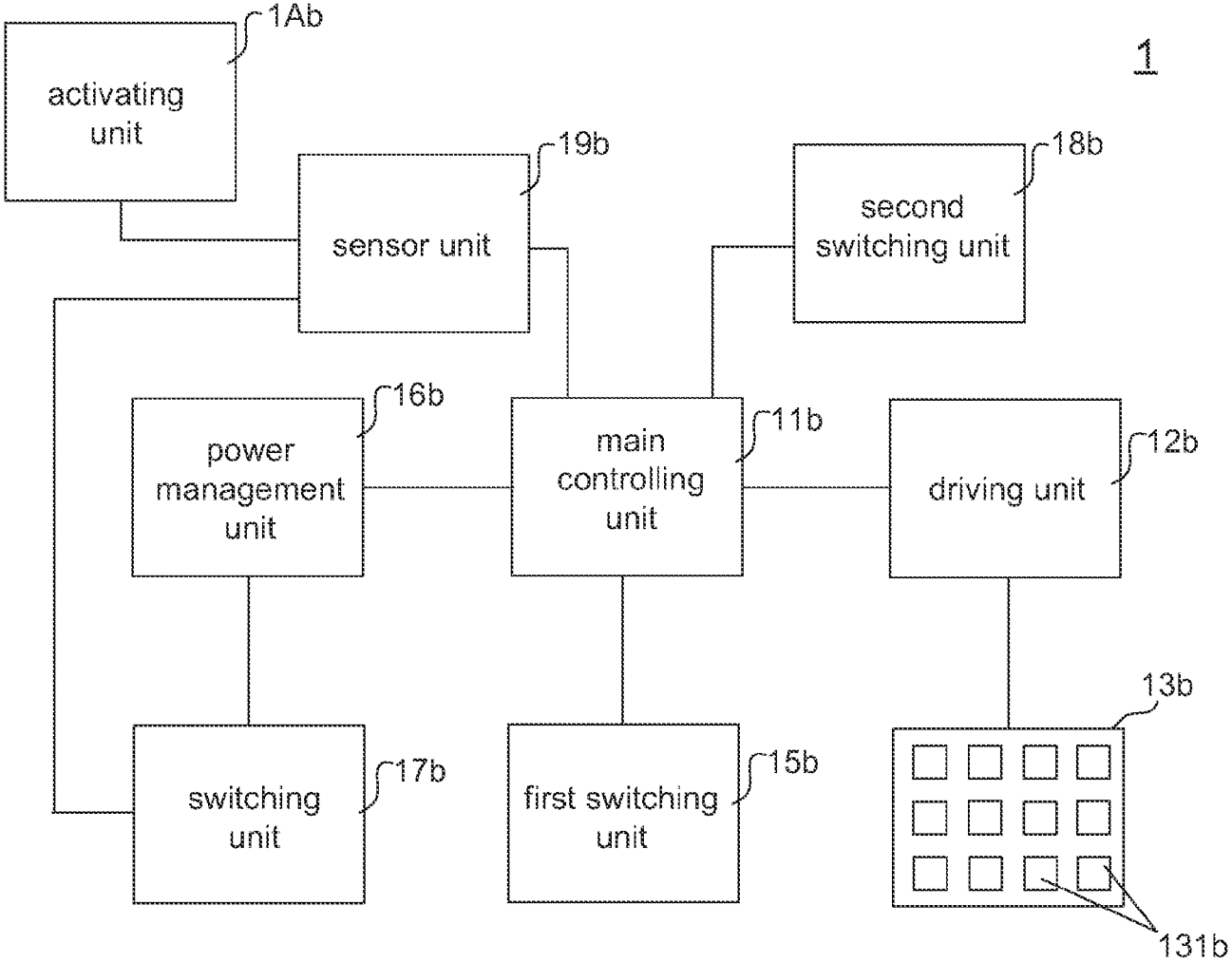
FIG. 7 is a framework view of a fourth embodiment of the lighting device with switchable day/night illumination mode according to the present invention.

The present invention further includes a fourth embodiment for introducing the lighting device with switchable day/night illumination mode. Please refer to FIG. 7, which illustrates the framework view of a fourth embodiment of the lighting device with switchable day/night illumination mode according to the present invention. In the fourth embodiment, as shown in FIG. 7, the lighting device with switchable day/night illumination mode 1 includes: a main controlling unit 11*b*, a driving unit 12*b*, a light unit 13*b*, a first switching unit 15*b*, a power management unit 16*b*, a switching unit 17*b*, and a second switching unit 18*b*, in which, the main controlling unit 11*b*, the driving unit 12*b*, the light unit 13*b*, the first switching unit 15*b*, the power management unit 16*b*, and the switching unit 17*b* in the fourth embodiment are the same to the main controlling unit 11*b*, the driving unit 12*b*, the light unit 13*b*, the first switching unit 15*b*, the power management unit 16*b*, and the switching unit 17*b* in the aforesaid third embodiment.

Different from the third embodiment, in the fourth embodiment, the lighting device with switchable day/night illumination mode 1 further includes the second switching unit 18*b*, which is coupled to the main controlling unit 11*b*, wherein when the driving unit 12*b* drives the lighting unit 13*b* to output the visible light, the second switching unit 18*b* may be used for adjusting the intensity of the visible light outputted by the lighting unit 13*b*. Especially, since modern people popularly use the e-book as a reading device, for instance, iPAD®, so that, for some people having reading habit before bedtime, they can use the second switching unit 18*b* to adjust the intensity of the visible light outputted by the lighting unit 13*b* and use visible light with low intensity for assist in reading, so that, they can avoid from exciting their sympathetic and causing melatonin suppression. Of course, they also can utilize the sensor unit 19*b* to detect the light intensity of the environment, so as to determine whether adjust the intensity of the visible light outputted by the lighting unit 13*b* by the second switching unit 18*b*.

Therefore, the lighting device with switchable day/night illumination mode of the present invention has been disclosed completely and clearly through the above description. In summary, the present invention has the following advantages:

1. In the first embodiment of the present invention, a light filtering unit is used to cover the light-emitting surface of a lighting unit, so that, when the lighting unit outputs a visible light, the light filtering unit would filter the visible light and make the visible light become a visible light with a specific wavelength, i.e., the orange light having 617 nm wavelength, wherein the orange light causes the smallest excitation to human sympathetic; Therefore, using the orange light as illumination light when night can not only assist users in reading, but also avoid from exciting users' sympathetic and causing melatonin suppression.
2. Inheriting to above point 1, for the first embodiment of the present invention, it further includes an illumination mode switching unit, used for controlling and switching the light filtering unit, so that the light filtering unit shows and covers the light-emitting surface of the lighting unit, and then the visible light outputted from the lighting unit is filtered by the light filtering unit and becomes the visible light with the specific wavelength; Moreover, the illumination mode switching unit can control and switch the light filtering unit, such that the light filtering unit is withdrawn and stops covering the light-emitting surface of the lighting unit, and then the lighting unit outputs the normal visible light.
3. Moreover, for the first embodiment of the present invention, it further includes sensor unit, used for detecting the light intensity of the external environment, wherein when night is coming, the sensor unit 18 would output a first switch signal to the main controlling unit, and the main controlling unit would control the illumination mode switching unit to switch the light filtering unit to show and cover the light-emitting surface of the lighting unit; moreover, when day is coming, the sensor unit would output a second switch signal to the main controlling unit, and the main controlling unit would control the illumination mode switching unit to switch the light filtering unit to withdraw for stopping covering the light-emitting surface of the lighting unit.
4. In the second embodiment of the present invention, a light converting unit is used to cover the light-emitting surface of a lighting unit, so that, when the lighting unit outputs a visible light, the light converting unit would convert the visible light to a visible light with a specific wavelength, i.e., the orange light having 617 nm wavelength, wherein the orange light causes the smallest excitation to human sympathetic; Therefore, using the orange light as illumination light when night can not only assist users in reading, but also avoid from exciting users' sympathetic and causing melatonin suppression.

5. Inheriting to above points 2, 3 and 4, for the first embodiment of the present invention, it also includes an illumination mode switching unit and a sensor unit.
6. In addition to be applied as a display device of a notebook, the lighting device with switchable day/night illumination mode of the present invention can also be applied as the display device of an LCD TV, an LCD display, a smart phone, a multimedia player, and an e-book, so that, when night is coming, the user can control the first switching unit to switch and control the blue LED (OLED) chips not to emit light; thus, when the driving unit drives the light unit to output the visible light, the red LED (OLED) chips and the green LED (OLED) chips would emit the visible light with the specific wavelength ranging from 597 nm to 637 nm.
7. All the embodiment of the present invention can be added into a brightness switching unit for making the lighting device with switchable day/night illumination mode has the functionality for adjusting the intensity of the visible light outputted by the lighting unit; Therefore, for some people having reading habit before bedtime, they can use brightness switching unit to adjust the intensity of the visible light outputted by the lighting unit and use visible light with low intensity for assist in reading, so that, they can avoid from exciting their sympathetic and causing melatonin suppression.

The above description is made on embodiments of the present invention. However, the embodiments are not intended to limit scope of the present invention, and all equivalent implementations or alterations within the spirit of the present invention still fall within the scope of the present invention.

I claim:

1. A lighting device with switchable day/night illumination mode comprising:

a main controlling unit;

a driving unit, being coupled to the main controlling unit;

a lighting unit, being coupled to the driving unit and having a plurality of light-emitting devices, wherein the main controlling unit controls the driving unit to drive the lighting unit, so as to output a visible light;

a light filtering unit, being disposed over a light-emitting surface of the lighting unit, used for filtering the visible light and making the visible light become a visible light with a specific wavelength;

an illumination mode switching unit, being coupled to the main controlling unit, wherein the illumination mode switching unit is used for controlling and switching the light filtering unit, so that the light filtering unit shows and covers the light-emitting surface of the lighting unit, and then the visible light outputted from the lighting unit is filtered by the light filtering unit and becomes the visible light with the specific wavelength; moreover, the illumination mode switching unit is able to control and switch the light filtering unit, such that the light filtering unit is withdrawn and stops covering the light-emitting surface of the lighting unit, and then the lighting unit outputs the visible light; and a power management unit, being coupled to the main controlling unit for providing the power to the main controlling unit.

2. The lighting device with switchable day/night illumination mode of claim 1, further comprising:

a switching unit, being coupled to the power management unit for switching the power management unit ON/OFF; and a sensor unit, being coupled to the main controlling unit and the power management unit, used for detecting the light intensity of an external environment, wherein when night is coming, the sensor unit would output a first switch signal to the main controlling unit, and the main controlling unit would control the illumination mode switching unit to switch the light filtering unit to show and cover the light-emitting surface of the lighting unit; moreover, when day is coming, the sensor unit would output a second switch signal to the main controlling unit, and the main controlling unit would control the illumination mode switching unit to switch the light filtering unit to withdraw for stopping covering the light-emitting surface of the lighting unit.

3. The lighting device with switchable day/night illumination mode of claim 2, further comprising an activating unit, coupled to the sensor unit for activating the sensor unit to detect the light intensity of the environment.

4. The lighting device with switchable day/night illumination mode of claim 1, wherein the light-emitting device is selected from the group consisting of: bulb, fluorescent lamp, LED chip, and OLED chip.

5. The lighting device with switchable day/night illumination mode of claim 1, wherein the wavelength of the visible light with the specific wavelength ranging from 597 nm to 637 nm.

6. The lighting device with switchable day/night illumination mode of claim 1, wherein the power management unit is selected from the group consisting of: battery and power supply.

7. The lighting device with switchable day/night illumination mode of claim 1, further comprising a brightness switching unit, being coupled to the main controlling unit, wherein when the driving unit drives the lighting unit to output the visible light, the brightness switching unit may be used for adjusting the intensity of the visible light outputted by the lighting unit.

8. A lighting device with switchable day/night illumination mode comprising:

a main controlling unit;

a driving unit, being coupled to the main controlling unit;

a lighting unit, being coupled to the driving unit and having a plurality of light-emitting devices, wherein the main controlling unit controls the driving unit to drive the lighting unit, so as to output a visible light;

a light converting unit, being disposed over a light-emitting surface of the lighting unit, used for converting the visible light to a visible light with a specific wavelength;

an illumination mode switching unit, being coupled to the main controlling unit, wherein the illumination mode switching unit is used for controlling and switching the light converting unit, so that the light converting unit shows and covers the light-emitting surface of the lighting unit, and then the visible light outputted from the lighting unit is converted by the light converting unit and becomes the visible light with the specific wavelength; moreover, the illumination mode switching unit is able control and switch the light converting unit, such that the light converting unit is withdrawn and stops covering the light-emitting surface of the lighting unit, and then the lighting unit outputs the visible light; and a power management unit, being coupled to the main controlling unit for providing the power to the main controlling unit.

9. The lighting device with switchable day/night illumination mode of claim 8, further comprising:

a switching unit, being coupled to the power management unit for switching the power management unit ON/OFF; and a sensor unit, being coupled to the main controlling unit and the power management unit, used for detecting the light intensity of an external environment, wherein when night is coming, the sensor unit would output a first switch signal to the main controlling unit, and the main controlling unit would control the illumination mode switching unit to switch the light filtering unit to show and cover the light-emitting surface of the lighting unit; moreover, when day is coming, the sensor unit would output a second switch signal to the main controlling unit, and the main controlling unit would control the illumination mode switching unit to switch the light filtering unit to withdraw for stopping covering the light-emitting surface of the lighting unit.

10. The lighting device with switchable day/night illumination mode of claim 9, further comprising an activating unit, coupled to the sensor unit for activating the sensor unit to detect the light intensity of the environment.

11. The lighting device with switchable day/night illumination mode of claim 8, wherein the light-emitting device is selected from the group consisting of: bulb, fluorescent lamp, LED chip, and OLED chip.

12. The lighting device with switchable day/night illumination mode of claim 8, wherein the wavelength of the visible light with the specific wavelength ranging from 597 nm to 637 nm.

13. The lighting device with switchable day/night illumination mode of claim 8, wherein the power management unit is selected from the group consisting of: battery and power supply.

14. The lighting device with switchable day/night illumination mode of claim 8, further comprising a brightness switching unit, being coupled to the main controlling unit, wherein when the driving unit drives the lighting unit to output the visible light, the brightness switching unit may be used for adjusting the intensity of the visible light outputted by the lighting unit.

15. A lighting device with switchable day/night illumination mode comprising:

a main controlling unit;

a driving unit, being coupled to the main controlling unit;

a lighting unit, being coupled to the driving unit and having a plurality of light-emitting devices, wherein the main controlling unit controls the driving unit to drive the lighting unit, so as to output a visible light;

a first switching unit, being coupled to the main controlling unit, wherein when the driving unit drives the lighting unit to output the visible light, the first switching unit is used for controlling and adjusting the number of the plurality of light-emitting devices used for emitting light, or controlling some light-emitting devices in the plurality of light-emitting devices capable of emitting a visible light with a specific wavelength to emit light and controlling some light-emitting devices in the plurality of light-emitting devices incapable of emitting the visible light with the specific wavelength not to emit light; and a power management unit, being coupled to the main controlling unit for providing the power to the main controlling unit.

16. The lighting device with switchable day/night illumination mode of claim 15, further comprising:

a switching unit, being coupled to the power management unit for switching the power management unit ON/OFF;

a sensor unit, being coupled to the main controlling unit and the power management unit, used for detecting the light intensity of an external environment, wherein when night is coming, the sensor unit would output a first switch signal to the main controlling unit, and the main controlling unit would control the first switching unit to switch and adjust the number of the plurality of light-emitting devices used for emitting light, or control the some light-emitting devices in the plurality of light-emitting devices capable of emitting the visible light with the specific wavelength to emit light and control the some light-emitting devices in the plurality of light-emitting devices incapable of emitting the visible light with the specific wavelength not to emit light; and an activating unit, coupled to the sensor unit for activating the sensor unit to detect the light intensity of the environment.

17. The lighting device with switchable day/night illumination mode of claim 15, wherein the light-emitting device is selected from the group consisting of: bulb, fluorescent lamp, LED chip, and OLED chip.

18. The lighting device with switchable day/night illumination mode of claim 15, wherein the wavelength of the visible light with the specific wavelength ranging from 597 nm to 637 nm.

19. The lighting device with switchable day/night illumination mode of claim 15, wherein the power management unit is selected from the group consisting of: battery and power supply.

20. The lighting device with switchable day/night illumination mode of claim 15, further comprising a second switching unit, being coupled to the main controlling unit, wherein when the driving unit drives the lighting unit to output the visible light, the second switching unit may be used for adjusting the intensity of the visible light outputted by the lighting unit.

* * * * *